US011848516B2

(12) United States Patent
Scheer et al.

(10) Patent No.: US 11,848,516 B2
(45) Date of Patent: Dec. 19, 2023

(54) PLUG CONNECTOR, MATING CONNECTOR AND PLUG CONNECTOR SYSTEM

(71) Applicant: TE Connectivity Germany GmbH, Bensheim (DE)

(72) Inventors: Kevin Scheer, Bensheim (DE); Harald Ulrich, Bensheim (DE); Stefan Masak, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 190 days.

(21) Appl. No.: 17/308,251

(22) Filed: May 5, 2021

(65) Prior Publication Data

US 2021/0351545 A1 Nov. 11, 2021

(30) Foreign Application Priority Data

May 5, 2020 (DE) ..... 10 2020 112 117.2

(51) Int. Cl.

| | |
|---|---|
| ***H01R 13/627*** | (2006.01) |
| ***H01R 13/42*** | (2006.01) |
| ***H01R 13/635*** | (2006.01) |
| ***H01R 13/639*** | (2006.01) |

(52) U.S. Cl.

CPC ..... *H01R 13/627* (2013.01); *H01R 13/42* (2013.01); *H01R 13/635* (2013.01); *H01R 13/639* (2013.01)

(58) Field of Classification Search

CPC ..... H01R 13/627; H01R 13/44

See application file for complete search history.

(56) References Cited

U.S. PATENT DOCUMENTS

| | | | | |
|---|---|---|---|---|
| 3,644,938 A * | 2/1972 | Slate | H01R 13/633 | 439/349 |
| 3,793,610 A * | 2/1974 | Brishka | H01R 13/6277 | 439/352 |
| 3,818,421 A * | 6/1974 | Kruger | H01R 13/17 | 333/260 |
| 4,749,357 A * | 6/1988 | Foley | H01R 13/187 | 439/78 |
| 5,195,904 A * | 3/1993 | Cyvoct | H01R 13/6277 | 439/349 |
| 5,588,852 A * | 12/1996 | Puerner | H01R 13/44 | 439/752 |
| 5,653,615 A * | 8/1997 | Inaba | H01R 43/16 | 439/843 |
| 5,703,324 A * | 12/1997 | Harder | H01R 24/28 | 174/21 C |

(Continued)

FOREIGN PATENT DOCUMENTS

| | | |
|---|---|---|
| CN | 203800335 U | 8/2014 |
| CN | 204088660 U | 1/2015 |

OTHER PUBLICATIONS

Extended European Search Report, App. No. 21172188.1-1201, dated Sep. 29, 2021, 8 pages.

*Primary Examiner* — Neil Abrams
(74) *Attorney, Agent, or Firm* — Barley Snyder

(57) ABSTRACT

A plug connector pluggable with a mating connector in a connecting direction has a locking spring. The locking spring exerts a force on a pressure chamfer of the mating connector acting in the connecting direction when the plug connector is fully plugged together with the mating connector.

14 Claims, 4 Drawing Sheets

(56) References Cited

U.S. PATENT DOCUMENTS

| | | | | |
|---|---|---|---|---|
| 5,752,847 | A * | 5/1998 | McCormick | H01R 13/635 439/310 |
| 6,146,211 | A * | 11/2000 | Okamoto | H01R 13/44 439/825 |
| 6,835,084 | B2 * | 12/2004 | Poon | H01R 13/187 439/352 |
| 7,234,956 | B2 * | 6/2007 | Kauffman | H01R 13/6277 439/322 |
| 7,789,667 | B2 * | 9/2010 | Zhu | H01R 13/6205 439/271 |
| 8,342,893 | B2 * | 1/2013 | Glick | H01R 13/187 439/840 |
| 8,851,939 | B2 * | 10/2014 | Bazenas | F16F 1/045 439/840 |
| 9,534,625 | B2 | 1/2017 | Balsells | |
| 9,829,028 | B2 * | 11/2017 | Changsrivong | F16B 21/073 |
| 9,882,332 | B2 * | 1/2018 | Frederick | H01R 43/26 |
| 10,348,037 | B2 * | 7/2019 | Ilie | H01R 13/2457 |
| 10,804,623 | B2 * | 10/2020 | Minamino | H01R 4/4881 |
| 11,394,147 | B2 * | 7/2022 | Mangstl | H01R 13/052 |
| 11,658,435 | B2 * | 5/2023 | Li | H01R 4/34 439/382 |
| 2003/0094812 | A1 * | 5/2003 | Balsells | F16L 37/084 285/318 |
| 2021/0351545 | A1 * | 11/2021 | Scheer | H01R 13/42 |

* cited by examiner

PLUG CONNECTOR, MATING CONNECTOR AND PLUG CONNECTOR SYSTEM

CROSS-REFERENCE TO RELATED APPLICATIONS

This application claims the benefit of the filing date under 35 U.S.C. § 119(a)-(d) of German Patent Application No. 102020112117.2, filed on May 5, 2020.

FIELD OF THE INVENTION

The present invention relates to a connector and, more particularly, to a plug connector.

BACKGROUND

Plug connector systems, including a plug connector and a mating connector matable with the plug connector, are known in many variants.

SUMMARY

A plug connector pluggable with a mating connector in a connecting direction has a locking spring. The locking spring exerts a force on a pressure chamfer of the mating connector acting in the connecting direction when the plug connector is fully plugged together with the mating connector.3235Appli

BRIEF DESCRIPTION OF THE DRAWINGS

The invention will now be described by way of example with reference to the accompanying Figures, of which.

DETAILED DESCRIPTION OF THE EMBODIMENT(S)

The properties, features and advantageous aspects of this invention will be explained in more detail below with reference to the accompanying figures.

Figure 1:
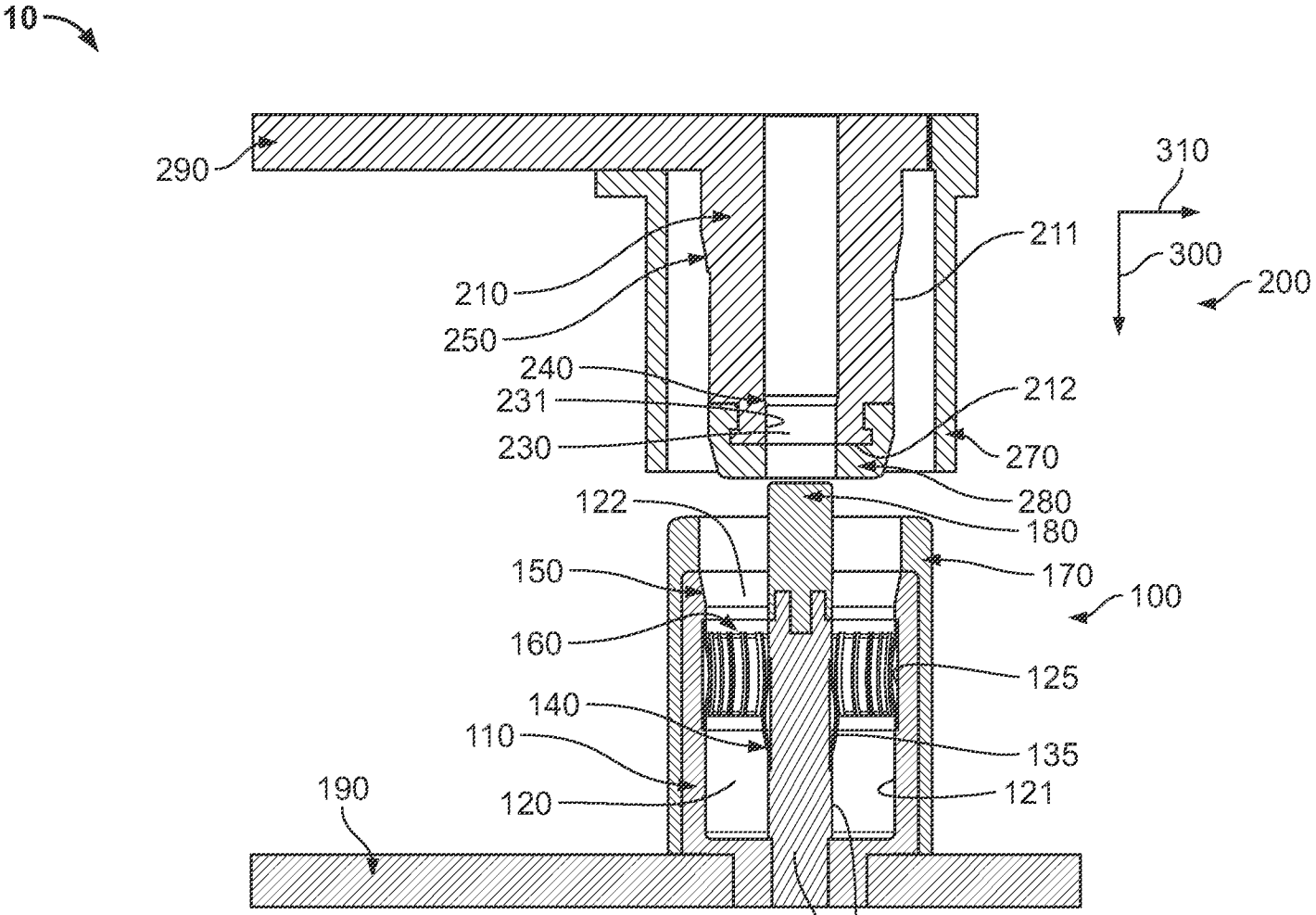
FIG. 1 is a sectional side view of a plug connector system according to an embodiment in an unconnected state.

FIG. 1 shows a schematic sectional side view of a plug connector system 10. The plug connector system 10 comprises a plug connector 100 and a mating connector 200. The plug connector system 10 is provided to establish an electrically conductive connection between a first conductor 190 and a second conductor 290. The first conductor 190 and the second conductor 290 are illustrated merely schematically in FIG. 1. The first conductor 190 can be designed as a busbar, for example. The plug connector 100 is connected to the first conductor 190 in an electrically conductive manner and can be designed as a fixed plug connector, for example. The mating connector 200 is connected to the second conductor 290 in an electrically conductive manner an can be designed as a movable plug, for example. The plug connector system 10 can be provided for use in the automotive industry, for example.

The plug connector 100 has a contact socket 110, as shown in FIG. 1. The contact socket 110 comprises an electrically conductive material, for example a metal. The contact socket 110 of the plug connector 100 is connected to the first conductor 190 in an electrically conductive manner.

The contact socket 110 has a receiving region 120. At an axial end face of the contact socket 110, the contact socket 110 has an insertion opening 122 at which a receiving region 120 is open. The insertion opening 122 is oriented perpendicularly to an axial direction of the contact socket 110. A connecting direction 300 is oriented parallel to the axial direction of the contact socket 110 and leads from the outside through the insertion opening 122 into the receiving region 120 of the contact socket 110 of the plug connector 100. An inner wall of the contact socket 110 forms a wall 121 of the receiving region 120.

An outer wall of the contact socket 110 of the plug connector 100 is covered by an outer touch protection 170, as shown in FIG. 1. The outer touch protection 170 can also extend beyond the insertion opening 122 of the contact socket 110 and have a corresponding opening. The outer touch protection 170 comprises an electrically insulating material, for example a plastic material. The outer touch protection 170 is provided to prevent the electrically conductive contact socket 110 from being touched accidentally. However, the outer touch protection 170 can also be omitted.

As shown in FIG. 1, a substantially cylindrical holding pin 130 is arranged in the receiving region 120 of the contact socket 110. The holding pin 130 is arranged centrally in the receiving region 120 and oriented parallel to the axis of the contact socket 110. In an embodiment, the holding pin 130 comprises an electrically conductive material and is connected to the contact socket 110 in an electrically conductive manner. However, it is also possible to form the holding pin 130 from an electrically insulating material. The holding pin 130 can prevent an inner region of the contact socket 110 from being touched accidently. The holding pin 130 can also serve as a centering aid when connecting the plug connector 100 to the mating connector 200.

An inner touch protection 180 is formed on an end face of the holding pin 130 which is oriented towards the insertion opening 122 of the contact socket 110. The inner touch protection 180 comprises an electrically insulating material, for example a plastic material. The inner touch protection 180 is provided to prevent the holding pin 130 and the wall 121 of the receiving region 120 of the contact socket 110 from being touched accidentally. However, the inner touch protection 180 can also be omitted.

As shown in FIG. 1, the contact socket 110 of the plug connector 100 has, near to the insertion opening 122, a contact chamfer 150 which is formed by a portion of the wall 121 of the receiving region 120. The receiving region 120 tapers in the connecting direction 300 in the region of the contact chamfer 150. The receiving region 120 therefore widens in the region of the contact chamfer 150, from an interior of the contact socket 110 in the direction of the insertion opening 122.

A contact spring 160 is arranged on the wall 121 of the receiving region 120 of the contact socket 110 of the plug connector 100, as shown in FIG. 1. The contact spring 160 comprises an electrically conductive material, for example a metal. The contact spring 160 can comprise copper, for example. The contact spring 160 can be fastened, for example, in a groove 125 formed in the wall 121 of the receiving region 120. In this case, the contact spring 160 projects from the wall 121 of the receiving region 120 into the interior of the receiving region 120 in a direction counter to the radial direction 310. The contact spring 160 is resiliently deformable.

A locking spring 140 is arranged on a lateral surface 131 of the holding pin 130. The locking spring 140 surrounds the holding pin 130 in the form of a sleeve. The locking spring 140 can be arranged in a groove 135 formed on the lateral surface 131 of the holding pin 130. The locking spring 140 projects from the lateral surface 131 of the holding pin 130 into the receiving region 120 counter to the radial direction 310. In this case, the locking spring 140 is elastically deformable. The locking spring 140 can be formed from steel, for example. Arranging the locking spring 140 in the receiving region 120 protects it from damage.

As shown in FIG. 1, the mating connector 200 of the plug connector system 10 has a contact pin 210. The contact pin 210 comprises an electrically conductive material and is connected to the second conductor 290 in an electrically conductive manner. It is expedient if the contact pin 210 comprises a metal. The contact pin 210 of the mating connector 200 is provided to be inserted into the receiving region 120 of the contact socket 110 of the plug connector 100 in the connecting direction 300. To this end, the mating connector 200 is oriented such that a longitudinal axis of the contact pin 210 is oriented parallel to the connecting direction 300. An end face 212 of the contact pin 210 of the mating connector 200 is then oriented perpendicularly to the connecting direction 300 and faces the insertion opening 122 of the contact socket 110 of the plug connector 100.

A mating contact chamfer 250, shown in FIG. 1, is formed on a lateral surface 211 of the contact pin 210 of the mating connector 200. The contact pin 210 tapers in the connecting direction 300 in the region of the mating contact chamfer 250, which means that a diameter, measured in the radial direction 310, of the contact pin 210 decreases in the connecting direction 300.

A pin receiving opening 230 is formed on the end face 212 of the contact pin 210 of the mating connector 200, which pin receiving opening 230 extends into the contact pin 210 counter to the connecting direction 300. The pin receiving opening 230 is provided to receive the holding pin 130 of the plug connector 100. The pin receiving opening 230 and the holding pin 130 can advantageously serve as a centering aid when plugging together the mating connector 200 and the plug connector 100.

As shown in FIG. 1, a pressure chamfer 240 is formed on a wall 231 of the pin receiving opening 230. In this case, the pin receiving opening 230 tapers in the connecting direction 300 in the region of the pressure chamfer 240. The diameter, measured in the radial direction 310, of the pin receiving opening 230 therefore decreases in the connecting direction 300 in the region of the pressure chamfer 240.

The mating connector 200 has an outer touch protection 270, as shown in FIG. 1, which surrounds the contact pin 210 in the form of a sleeve and is provided to prevent the contact pin 210 from being touched accidentally. The outer touch protection 270 is designed such that the outer touch protection 270 of the mating connector 200 surrounds the outer touch protection 170 of the plug connector 100 when the mating connector 200 is plugged together with the plug connector 100. The outer touch protection 270 comprises an electrically insulating material, for example a plastic material. The outer touch protection 270 can be omitted in a simplified variant of the mating connector 200.

The mating connector 200 additionally has an inner touch protection 280, which is arranged on the end face 212 of the contact pin 210 and has an opening which is coaxial to the pin receiving opening 230. The inner touch protection 280 is provided to prevent the contact pin 210 from being touched accidentally. The inner touch protection 280 comprises an electrically insulating material, for example a plastic material. The inner touch protection 280 can also be omitted in a simplified version.

Figure 2:
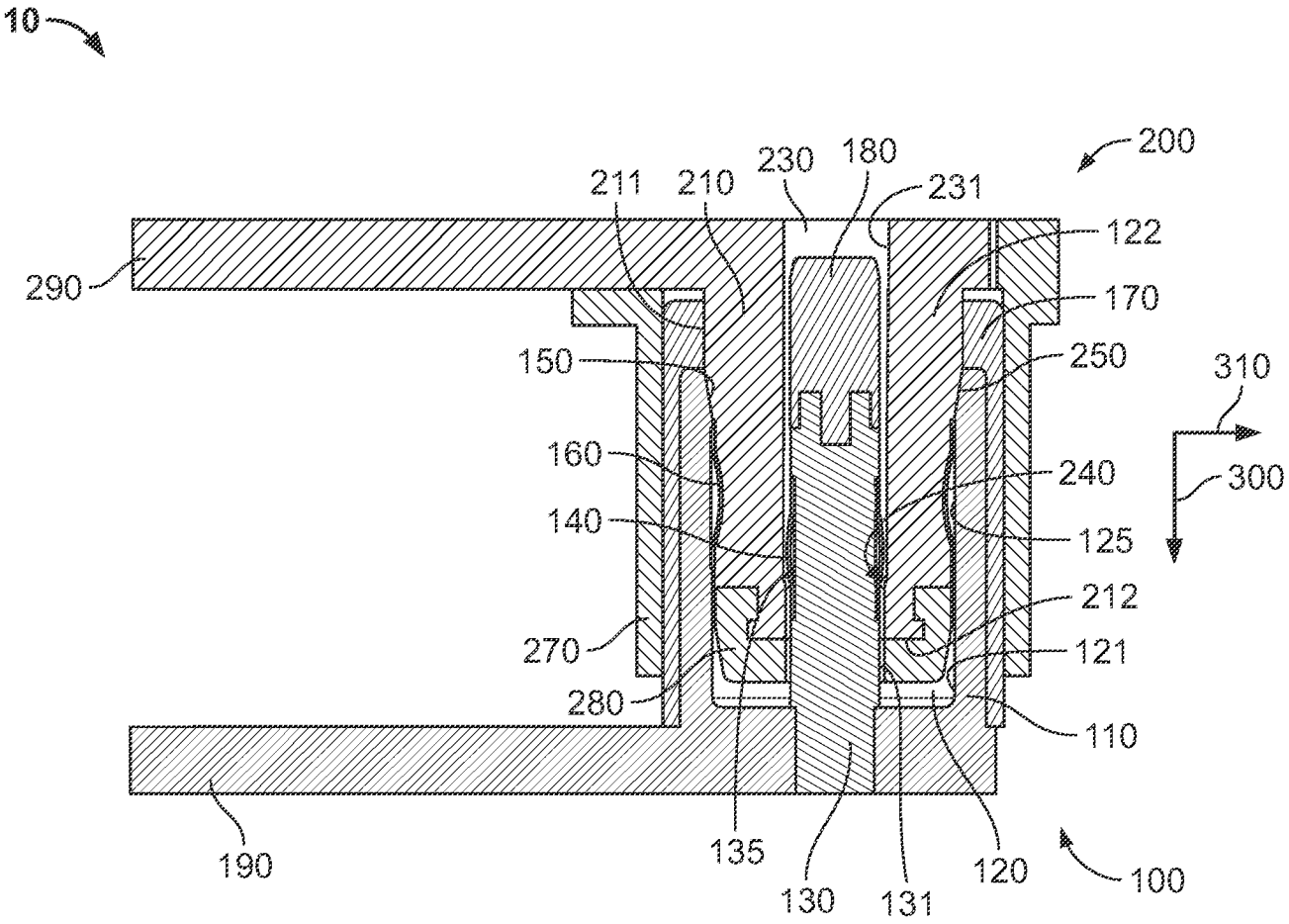
FIG. 2 is a sectional side view of the plug connector system of FIG. 1 in a connected state.

The mating connector 200 of the plug connector system 10 can be plugged together with the plug connector 100 of the plug connector system 10 in that the contact pin 210 of the mating connector 200 is inserted into the receiving region 120 of the plug connector 100 in the connecting direction 300. In this case, the holding pin 130 of the plug connector 100 is received in the pin receiving opening 230 of the contact pin 210 of the mating connector 200. FIG. 2 shows a schematic sectional side view of the plug connector 100 and the mating connector 200 of the plug connector system 10 in the fully plugged together state. The holding pin 130 of the plug connector 100 has been received in the pin receiving opening 230 of the contact pin 210 of the mating connector 200.

As shown in FIG. 2, the locking spring 140 arranged on the holding pin 130 has been elastically deformed and lies against the pressure chamfer 240 of the wall 231 of the pin receiving opening 230 of the contact pin 210. As a result of the orientation of the pressure chamfer 240, a force, acting in the connecting direction 300, is exerted on the contact pin 210 of the mating connector 200 by the locking spring 140 lying against the pressure chamfer 240. As a result of the force acting on the pressure chamfer 240, the mating connector 200 is securely held on the plug connector 100 against vibration. The pressure chamfer 240 can provide an electrically conductive contact point between the mating connector 200 and the plug connector 100.

As a result of the force exerted on the pressure chamfer 240 by the locking spring 140, the contact pin 210 of the mating connector 200 is drawn into the receiving region 120 of the contact socket 110 of the plug connector 100 in the connecting direction 300 and held in the contact socket 110 of the plug connector 100. In addition, the locking spring 140 can also establish an electrically conductive connection between the holding pin 130 of the plug connector 100 and the contact pin 210 of the mating connector 200. As a result, the vibration resistance of the plug connector 100 can also be increased. The pressing function is advantageously fulfilled by the locking spring 140, so that it is not necessary to realize a pressing action by a plastic housing of the plug connector 100, for example. A reduction in the pressing force due to material fatigue can thus be prevented. The locking spring 140 can also provide an additional electrical contact point between the plug connector 100 and the mating connector 200.

The contact spring 160 of the plug connector 100, which is arranged in the receiving region 120 on the wall 121 of the receiving region 120, has been elastically deformed as a result of the insertion of the contact pin 210 of the mating connector 200 and now presses against the lateral surface 211 of the contact pin 210 counter to the radial direction 310, as shown in FIG. 2. The contact spring 160 thus establishes an electrically conductive connection between the contact socket 110 of the plug connector 100 and the contact pin 210 of the mating connector 200.

The mating contact chamfer 250 of the contact pin 210 of the mating connector 200 which is fully plugged together with the plug connector 100 is in contact with the contact chamfer 150 of the contact socket 110 of the plug connector 100, as shown in FIG. 2. The mating contact chamfer 250 of the mating connector 200 is pressed against the contact chamfer 150 of the plug connector 100 as a result of the force exerted on the pressure chamfer 240 of the mating connector 200 by the locking spring 140 of the plug connector 100. A reliable electrical contact is thus formed between the contact chamfer 150 of the plug connector 100 and the mating contact chamfer 250.

The contact spring 160 of the plug connector 100 can be omitted in a simplified embodiment of the plug connector system 10. In this case, an electrically conductive connection between the plug connector 100 and the mating connector 200 is established merely by the contact between the contact chamfer 150 of the plug connector 100 and the mating contact chamfer 250 of the mating connector 200 and possibly by the contact between the locking spring 140 of the plug connector 100 and the pressure chamfer 240 of the mating connector 200.

Figure 3:
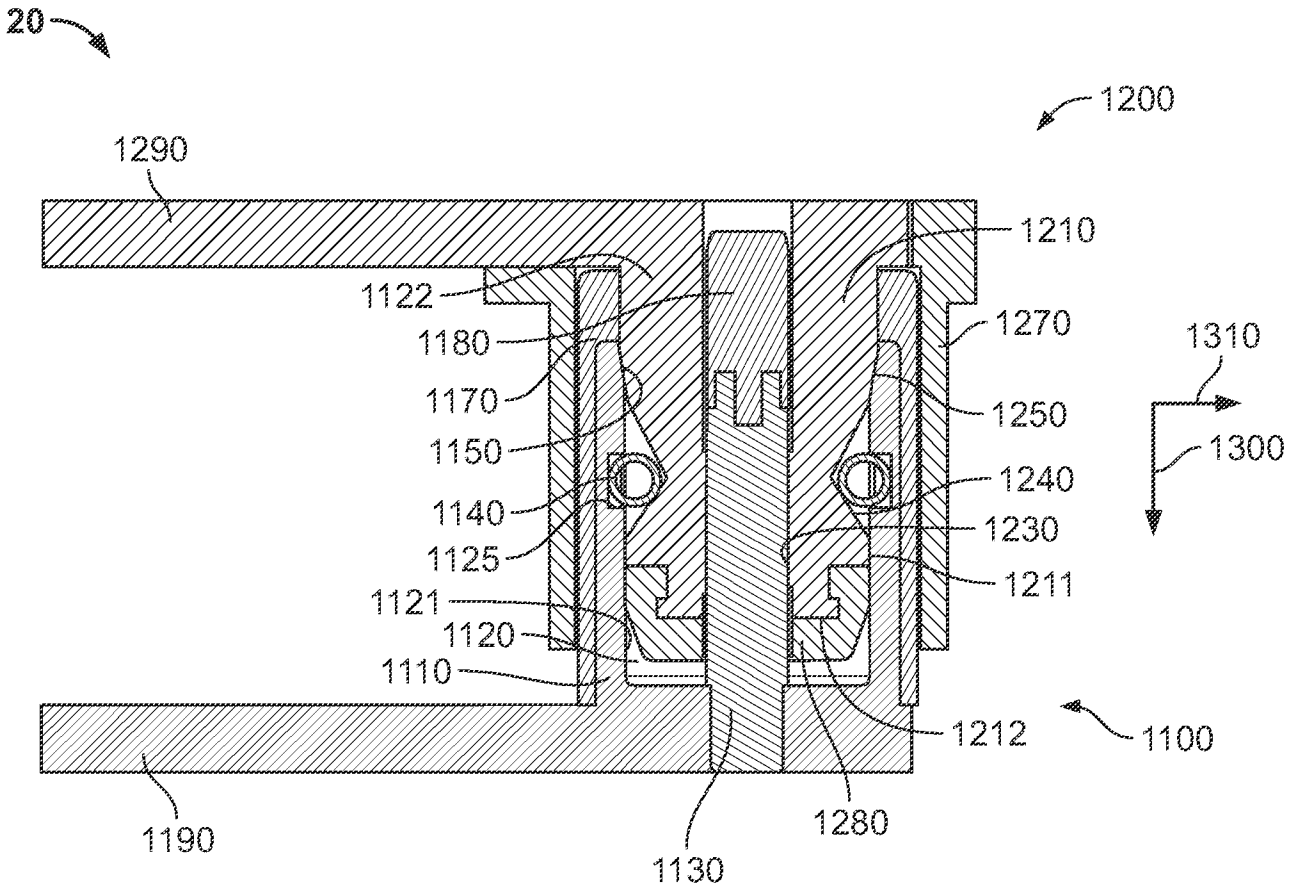
FIG. 3 is a sectional side view of a plug connector system according to another embodiment in a connected state.

FIG. 3 shows a schematic sectional side view of a plug connector system 20 according to another embodiment. The plug connector system 20 has many similarities to the plug connector system 10 described above with reference to FIGS. 1 and 2. Components of the plug connector system 20 which correspond to components present in the plug connector system 10 are not described in detail again below. In this regard, the description above of the plug connector system 10 also applies to the plug connector system 20.

The plug connector system 20, as shown in FIG. 3, comprises a plug connector 1100 which corresponds to the plug connector 100 of the plug connector system 10 and is connected to a first conductor 1190 in an electrically conductive manner, which first conductor 1190 corresponds to the first conductor 190 of FIGS. 1 and 2. The plug connector system 20 moreover comprises a mating connector 1200 which corresponds to the mating connector 200 of the plug connector system 10 and is connected to a second conductor 1290 in an electrically conductive manner, which second conductor 1290 corresponds to the second conductor 290 of FIGS. 1 and 2. FIG. 3 shows the plug connector 1100 and the mating connector 1200 of the plug connector system 20 in a fully plugged together state in which the plug connector 1100 and the mating connector 1200 establish an electrically conductive connection between the first conductor 1190 and the second conductor 1290.

The plug connector 1100 has a contact socket 1110 with a receiving region 1120 which, apart from the differences described below, correspond to the contact socket 110 and the receiving region 120 of the plug connector 100 of the plug connector system 10. The mating connector 1200 has a contact pin 1210 with an end face 1212 which, apart from the differences described below, corresponds to the contact pin 210 of the mating connector 200 of the plug connector system 10. The contact pin 1210 of the mating connector 1200 can be inserted into the receiving region 1120 in a connecting direction 1300 through an insertion opening 1122 of the contact socket 1110.

A holding pin 1130 is arranged in the receiving region 1120 of the contact socket 1110, which holding pin 1130, apart from the differences described below, corresponds to the holding pin 130 of the plug connector 100. The contact pin 1210 of the mating connector 1200 has a pin receiving opening 1230, which is provided to receive the holding pin 1130. The pin receiving opening 1230 of the mating connector 1200 corresponds to the pin receiving opening 230 of the mating connector 200, although it does not have a pressure chamfer.

As shown in FIG. 3, the plug connector 1100 has an outer touch protection 1170 and an inner touch protection 1180, which are designed in the same manner as the outer touch protection 170 and the inner touch protection 180 of the plug connector 100. The mating connector 1200 has an outer touch protection 1270 and an inner touch protection 1280, which are designed in the same manner as the outer touch protection 270 and the inner touch protection 280 of the mating connector 200 of the plug connector system 10. The outer touch protection 1170 and the inner touch protection 1180 of the plug connector 1100 and the outer touch protection 1270 and the inner touch protection 1280 of the mating connector 1200 can in turn be omitted in all cases or in some cases.

It is possible to form the holding pin 1130 of the plug connector 1100 of the plug connector system 20 entirely from an electrically insulating material. A separate inner touch protection 1280 is then not required, but is instead formed by a portion of the holding pin 1130.

The plug connector 1100 of the plug connector system 20 has a contact chamfer 1150, which is designed in the same manner as the contact chamfer 150 of the plug connector 100 of the plug connector system 10. The mating connector 1200 has a mating contact chamfer 1250, which is designed in the same manner as the mating contact chamfer 250 of the mating connector 200. The contact chamfer 1150 of the plug connector 1100 is in turn pressed against the mating contact chamfer 1250 of the mating connector 1200 when the plug connector 1100 and the mating connector 1200 are fully plugged together.

The plug connector 1100 of the plug connector system 20 has neither a contact spring nor a groove provided to receive the contact spring. Instead, in the plug connector 1100 shown in FIG. 3, a groove 1125 is arranged in a wall 1121 of the receiving region 1120, in which groove 1125 a locking spring 1140 is arranged. The locking spring 1140 can be designed as an annular spring or as an annular helical spring, for example.

As shown in FIG. 3, in the mating connector 1200 of the plug connector system 20, a pressure chamfer 1240 is formed on a lateral surface 1211 of the contact pin 1210. The pressure chamfer 1240 is formed such that the contact pin 1210 widens in the connecting direction 1300 in the region of the pressure chamfer 1240. This means that a diameter, measured in the radial direction 1310, of the contact pin 1210 increases in the connecting direction 1300 in the region of the pressure chamfer 1240.

In the state of the plug connector system 20 shown in FIG. 3 in which the plug connector 1100 and the mating connector 1200 are fully plugged together, the locking spring 1140 of the plug connector 1100 exerts a force on the pressure chamfer 1240 of the mating connector 1200, which, as a result of the orientation of the pressure chamfer 1240, produces a force, acting in the connecting direction 1300, on the contact pin 1210 of the mating connector 1200. The mating connector 1200 is thus held firmly on the plug connector 1100. Moreover, the mating contact chamfer 1250 of the mating connector 1200 is thus pressed firmly against the contact chamfer 1150 of the plug connector 1100. In addition, the locking spring 1140 can also establish an electrically conductive connection between the contact socket 1110 of the plug connector 1100 and the contact pin 1210 of the mating connector 1200.

Figure 4:
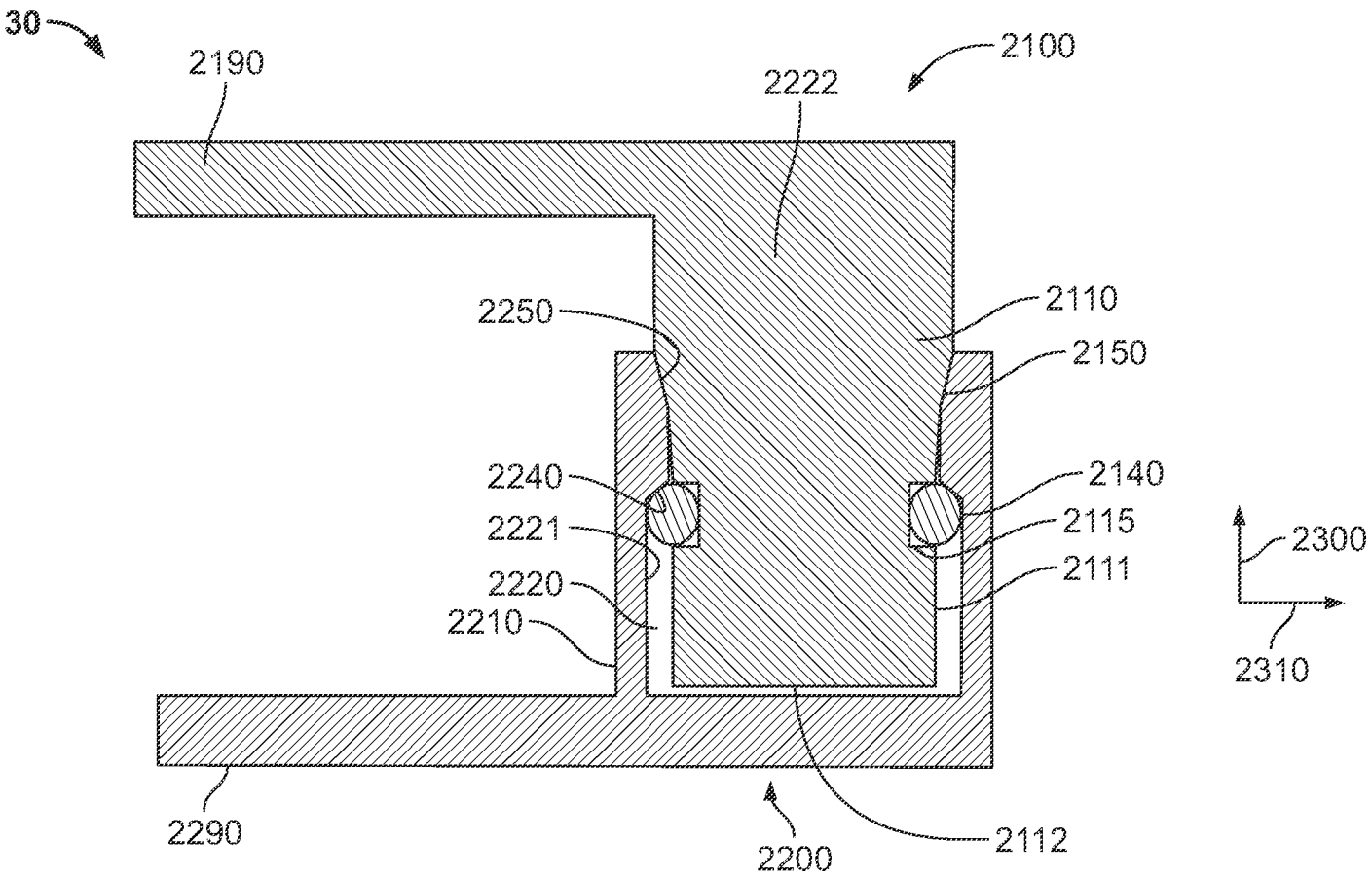
FIG. 4 is a sectional side view of a plug connector system according to a further embodiment in a connected state.

FIG. 4 shows a schematic sectional side view of a plug connector system 30 according to another embodiment. The plug connector system 30 has many similarities to the plug connector system 10 of FIGS. 1 and 2 and the plug connector system 20 of FIG. 3. Apart from the differences described below, the description above of the plug connector system 10 and the plug connector system 20 also applies to the plug connector system 30 of FIG. 4.

The plug connector system 30 comprises a plug connector 2100 and a mating connector 2200, as shown in FIG. 4. The plug connector 2100 is connected to a first conductor 2190. The mating connector 2200 is connected to a second conductor 2290. The plug connector system 30 is provided to establish an electrically conductive connection between the first conductor 2190 and the second conductor 2290 when the plug connector 2100 and the mating connector 2200 are fully plugged together, as illustrated in FIG. 4.

As shown in FIG. 4, the mating connector 2200 of the plug connector system 30 has a contact socket 2210 with a receiving region 2220. The mating connector 2200 of the plug connector system 30 therefore has similarities to the plug connector 100 of the plug connector system 10. The plug connector 2100 of the plug connector system 30 has a contact pin 2110. The plug connector 2100 therefore has similarities to the mating connector 200 of the plug connector system 10. Leading with an end face 2112, the contact pin 2110 of the plug connector 2100 can be inserted into the receiving region 2220 of the contact socket 2210 of the mating connector 2200 counter to a connecting direction 2300 through an insertion opening 2222 of the receiving region 2220.

In the plug connector system 30, the plug connector 2100 also has a locking spring 2140. The locking spring 2140 is arranged on a lateral surface 2111 of the contact pin 2110. To this end, the lateral surface 2111 of the contact pin 2110 can have a circumferential groove 2115 in which the locking spring 2140 is held. The locking spring 2140 can be designed in the same manner as the locking spring 1140 of the plug connector 1100 of the plug connector system 20.

In the mating connector 2200 of the plug connector system 30, a pressure chamfer 2240 is formed on a wall 2221 of the receiving region 2220. The receiving region 2220 tapers in the connecting direction 2300 in the region of the pressure chamfer 2240. This means that a diameter, measured in a radial direction 2310, of the receiving region 2220 of the contact socket 2210 of the mating connector 2200 decreases in the connecting direction 2300 in the region of the pressure chamfer 2240.

The contact pin 2110 of the plug connector 2100 has a contact chamfer 2150 on its lateral surface 2111, which contact chamfer 2150 is designed such that the contact pin 2110 widens in the connecting direction 2300 in the region of the contact chamfer 2150. Therefore, a diameter, measured in the radial direction 2310, of the contact pin 2110 increases in the connecting direction 2300 in the region of the contact chamfer 2150.

The contact socket 2210 of the mating connector 2200 has a mating contact chamfer 2250 at which the receiving region 2220 widens in the connecting direction 2300. The mating contact chamfer 2250 is formed by a portion of the wall 2221 of the receiving region 2220 near to the insertion opening 2222. A diameter, measured in the radial direction 2310, of the receiving region 2220 increases in the connecting direction 2300 in the region of the mating contact chamfer 2250.

When the plug connector 2100 of the plug connector system 30 is fully plugged together with the mating connector 2200, as shown in FIG. 4, the locking spring 2140 of the plug connector 2100 exerts a force on the pressure chamfer 2240 of the mating connector 2200, which results in a force, acting in the connecting direction 2300, on the mating connector 2200 owing to the orientation of the pressure chamfer 2240. The plug connector 2100 and the mating connector 2200 are thus pressed firmly together.

In the fully plugged together state of the plug connector 2100 and the mating connector 2200, the contact chamfer 2150 of the plug connector 2100 lies against the mating contact chamfer 2250 of the mating connector 2200. The force exerted on the mating connector 2200 by the locking spring 2140 of the plug connector 2100 presses the contact chamfer 2150 against the mating contact chamfer 2250. This produces a reliable electrically conductive contact between the contact chamfer 2150 of the plug connector 2100 and the mating contact chamfer 2250 of the mating connector 2200 and therefore also between the contact pin 2110 of the plug connector 2100 and the contact socket 2210 of the mating connector 2200. The contact between the locking spring 2140 of the plug connector 2100 and the pressure chamfer 2240 of the mating connector 2200 can establish a further electrical contact between the contact pin 2110 of the plug connector 2100 and the contact socket 2210 of the mating connector 2200.

In the schematic illustration of FIG. 4, neither the plug connector 2100 nor the mating connector 2200 of the plug connector system 30 has a respective touch protection. It is, however, possible to design the plug connector 2100 with a touch protection which corresponds to that of the mating connector 200 of the plug connector system 10. Accordingly, the mating connector 2200 of the plug connector system 30 can be equipped with a touch protection which corresponds to that of the plug connector 100 of the plug connector system 10.

In the plug connector system 20 and the plug connector system 30, a contact spring can be additionally provided in each case, which contact spring is designed in the same manner as the contact spring 160 of the plug connector 100 of the plug connector system 10. In the plug connector system 20 of FIG. 3, this can be arranged in the receiving region 1120 of the plug connector 1100. In the plug connector system 30 of FIG. 4, this can be arranged in the receiving region 2220 of the mating connector 2200.

The plug connector system 30 of FIG. 4 can be additionally equipped with a holding pin. This can be designed in the same manner as the holding pin 1130 of the plug connector 1100 of the plug connector system 20, although it is arranged in the receiving region 2220 of the contact socket 2210 of the mating connector 2200. In this case, the contact pin 2110 of the plug connector 2100 has a pin receiving opening which corresponds to the pin receiving opening 1230 of the mating connector 1200 of the plug connector system 20.

What is claimed is:

1. A plug connector for use with a mating connector having a pressure chamfer, comprising:

a locking spring exerting a force on the pressure chamfer of the mating connector acting in the connecting direction when the plug connector is fully plugged together with the mating connector;

a contact pin having a receiving opening and a mating contact chamfer at which the contact pin tapers in the connecting direction, and being insertable into a receiving region of a contact socket of the plug connector in the connecting direction, the contact pin has the pressure chamfer, wherein the pressure chamfer is arranged on an outer lateral surface of the contact pin, and the contact pin widens in the connecting direction in a region of the pressure chamfer; and a contact socket having a holding pin positioned to engage the pressure chamfer of the mating connector, wherein the locking spring is arranged on the holding pin and surrounds the holding pin in a form of a sleeve.

2. The plug connector of claim 1, wherein the locking spring is an electrical contact point between the plug connector and the mating connector.

3. The plug connector of claim 1, wherein the holding pin is at least partly comprised of a non-conductive material.

4. The plug connector of claim 1, further comprising a contact spring arranged in the receiving region, the contact spring forms an electrically conductive connection between the contact socket and the contact pin of the mating connector.

5. The plug connector of claim 4, wherein the contact spring is arranged on a wall of the receiving region.

6. The plug connector of claim 1, wherein the locking spring is arranged on a wall of the receiving region.

7. The plug connector of claim 1, further comprising a holding pin insertable into a receiving region of a contact socket of the mating connector counter to the connecting direction, the locking spring is arranged on the contact pin.

8. The plug connector of claim 7, wherein the holding pin has a contact chamfer at which the contact pin widens in the connecting direction.

9. A mating connector pluggable with a plug connector in a connecting direction, comprising:

a pressure chamfer receiving a force from a locking spring of the plug connector acting in the connecting direction when the mating connector is fully plugged together with the plug connector, the pressure chamfer arranged on a wall of the pin receiving opening, the pin receiving opening tapers in the connecting direction in a region of the pressure chamfer; and a contact pin having a receiving opening and a mating contact chamfer at which the contact pin tapers in the connecting direction, and being insertable into a receiving region of a contact socket of the plug connector in the connecting direction, the contact pin has the pressure chamfer, wherein the pressure chamfer is arranged on an outer lateral surface of the contact pin, and the contact pin widens in the connecting direction in a region of the pressure chamfer.

10. The mating connector of claim 9, further comprising a contact socket with a receiving region, a contact pin of the plug connector is insertable into the receiving region counter to the connecting direction, the contact socket has the pressure chamfer.

11. The mating connector of claim 10, wherein the contact socket has a mating contact chamfer at which the receiving region widens in the connecting direction.

12. A plug connector system, comprising:

a mating connector having an axial opening and a pressure chamfer;

a contact pin having a receiving opening and a mating contact chamfer at which the contact pin tapers in the connecting direction, and being insertable into a receiving region of a contact socket of the plug connector in the connecting direction, the contact pin has the pressure chamfer, wherein the pressure chamfer is arranged on an outer lateral surface of the contact pin, and the contact pin widens in the connecting direction in a region of the pressure chamfer; and a plug connector pluggable with the mating connector in a connecting direction, the plug connector including a locking spring exerting a force on the pressure chamfer acting in the connecting direction when the plug connector is fully plugged together with the mating connector, and a contact socket having a centrally located holding pin positioned to engage the axial opening.

13. The plug connector system of claim 12, wherein the plug connector has a contact chamfer pressured against a mating contact chamfer of the mating connector when the plug connector and the mating connector are fully plugged together.

14. The plug connector system of claim 12, wherein the locking spring is an electrical contact point between the plug connector and the mating connector.

* * * * *